US005885167A

United States Patent [19]

St. Martin

[11] Patent Number: 5,885,167

[45] Date of Patent: Mar. 23, 1999

[54] BALL SUPPORT AND GOLF SWING AID FOR GOLF PRACTICE

[76] Inventor: Kirk D. St. Martin, 5464 W. Everett Ave., Fresno, Calif. 93722

[21] Appl. No.: 851,358

[22] Filed: May 5, 1997

[51] Int. Cl.[6] ..... A63B 69/36

[52] U.S. Cl. ..... 473/278; 473/388

[58] Field of Search ..... 473/278, 279, 473/387, 388

[56] References Cited

U.S. PATENT DOCUMENTS

| | | | |
|---|---|---|---|
| 1,783,211 | 12/1930 | Baldwin | 473/387 X |
| 3,423,096 | 1/1969 | Tone | 473/278 |
| 5,503,396 | 4/1996 | Veylupek et al. | 473/388 |

*Primary Examiner*—George J. Marlo

*Attorney, Agent, or Firm*—Richard A. Ryan

[57] ABSTRACT

A golf ball support and golf swing aid for golf practice that has a generally flat rectangular base made of a resiliently deformable material, such as found with some plastics, that enables the golfer to bend the base into a convex shape, forming an arch-like profile. The base has a smooth upper surface and a visual guide to denote the preferred direction of golf ball travel. A recess located on the base holds a golf ball in position on the base. The arch-like profile allows the golfer to use the golf aid to practice golf swings on any type of terrain, including rocky, barren and asphalt covered areas. The resiliently deformable material provides the golfer with a cushioned, spring-like resistance that prevents or reduces the amount of jarring shock experience by the golfer, while simulating the feel of a golf swing on a natural fairway and protecting the turf. The golf ball support is inexpensive to make, easy to transport and easy to use.

9 Claims, 2 Drawing Sheets

BALL SUPPORT AND GOLF SWING AID FOR GOLF PRACTICE

BACKGROUND OF THE INVENTION

1. Field of the Invention

The present invention relates generally to ball supports specially adapted for practicing golf. More particularly, the present invention relates to golf ball supports incorporated within a base that protect the ground surface from damage and the golfer from injury due to jarring. Even more particularly, the present invention relates to lightweight ball supports that provide a golfer with a golf ball support which allows the golfer to practice on rough surfaces and which incorporates a golf swing aid.

2. Background

In a common golf practice situation, the golfer wants to be able to stand in one place and practice hitting a golf ball in a certain direction. Depending on the type of golf club being used, the golf ball is either placed on the ground or on a conventional golf tee. When the ball sits on the ground, it is not uncommon that the ground around the ball is damaged by the golf club. Even if the golfer is using a tee, damage to the ground can result when the golfer misses and hits "short" of the ball. Because of the potential for turf damage, golf practice is banned on many fields, such as school yards and parks. As a result of such banning and the general unavailability of good turf areas, the golfer is often forced to practice in an area not having a good turf surface. At other times, the golfer may desire to practice at a location which is convenient to him or her, but which does not have a good playing surface, including locations with such surfaces as rocky or barren terrain, including asphalt. If the golfer is practicing on a non-turf area, a missed swing can result in damage to the club head and a substantial jarring shock to the golfer.

The use of a specially designed base from which a golf ball is hit is well known in the art. Generally, the golf ball support base is utilized during golf practice to serve a variety of purposes, such as protecting the turf below the support and providing a means for monitoring the golfer's swing. The prior golf practice bases are beset with a number of problems, including lack of wear resistance, inability to function on a surface that is not relatively smooth and devices which subject the golfer to a jarring shock when he or she makes a poor swing. In an attempt to address these problems and to provide a practice guide, a number of devices have been developed which are difficult to transport, expensive to manufacture and difficult to use, resulting in such devices being generally disfavored by golfers.

SUMMARY OF THE INVENTION

The ball support and golf swing aid in accordance with the present invention solves the problems associated with the prior golf practice bases described above. That is to say, the present invention provides a golf ball support base that is easily transportable, inexpensive to manufacture and easy to use. Specifically, the ball support and golf swing aid of the present invention utilizes a lightweight, resiliently deformable base that supports a golf ball above virtually any type of surface from which a golfer would want to practice his or her golf swing. In its preferable forms, the present invention contains no metal parts that may corrode or damage golf club heads or golf balls. It can be seen from the following discussion that the present invention provides a novel golf ball support base and golf swing aid for practicing golf.

The ball support and golf swing aid of the present invention has a substantially flat base which is preferably made of a lightweight, durable plastic or plastic-like material that is cut into a generally rectangular shape. In its preferred embodiment, the base of the present invention is made from a relatively thin (i.e., approximately one-eighth inch thick) plastic that is capable of being placed into a convex shape by the golfer, creating an arch-like profile, when desired for certain practice techniques and then placed back in a flat condition for other practice techniques and transport. The top surface of the base is smooth to allow a golf club head to slide over the surface with a minimum amount of friction.

Cut into the top surface of the base is a recess having a diameter and depth sufficient to keep a golf ball from falling off the top surface of the base when it is in either a flat or convex condition. In the preferred embodiment, the recess is placed at or near the center of the base. In this configuration, when the golfer bends the base in a convex shape, the golf ball will be raised above the ground surface in an amount selected by the golfer. The bottom of the recess can comprise a hole cut through the base to allow the insertion of a conventional golf tee therein.

To assist the golfer in improving his or her golf swing, the present invention is provided with a target line that denotes the preferred direction of travel for a golf ball hit from the base. The target line should be aimed in the intended direction of travel. In the preferred embodiment, the target line is a single strip of plastic tape centrally located along the longitudinal axis of the base. Preferably, the tape is placed on the bottom of the base to prevent the golf club head from damaging the target line during use. In order for the target line to be useful from the bottom of the base, the base should be made of a translucent material that allows the golfer to see the target line without damaging it during a swing. As an alternative, the target line can be incorporated within the base material itself or be made from a durable material that allows it to be placed on the top surface of the base.

Accordingly, the primary objective of the present invention is to provide a ball support and golf swing aid for golf practice of the character described herein, wherein the base is made from a durable, lightweight and resiliently deformable material suitable for placing the base in a convex, arch-like shape while supporting a golf ball for use by a golfer on any type of surface from which the golfer would want to practice his or her golf swing.

It is also an important objective of the present invention to provide a ball support and golf swing aid that prevents or reduces the effects from jarring and simulates the feel of hitting a golf ball on natural turf.

Another important objective of the present invention is to provide a ball support and golf swing aid that has a target line which denotes the preferred direction of golf ball travel to indicate to the golfer the direction he or she should be aiming.

Yet another important objective of the present invention is to provide a ball support and golf swing aid that has a target line denoted thereon in a manner that will not result in damage to the target line during use.

Yet another important objective of the present invention is to provide a ball support and golf swing aid that will not damage the golf club or golf ball during use.

Yet another important objective of the present invention is to provide a ball support and golf swing aid that is inexpensive to manufacture, easily transported and easy for the golfer to use.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
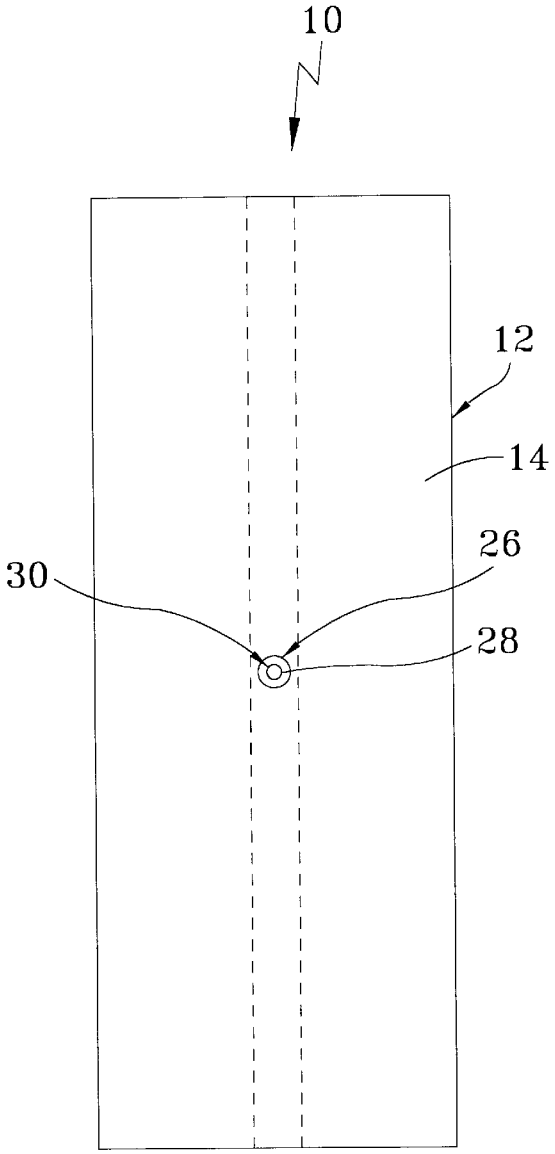
FIG. 1 is a top view showing a ball support and golf swing aid embodying the principles of the present invention.
Figure 2:
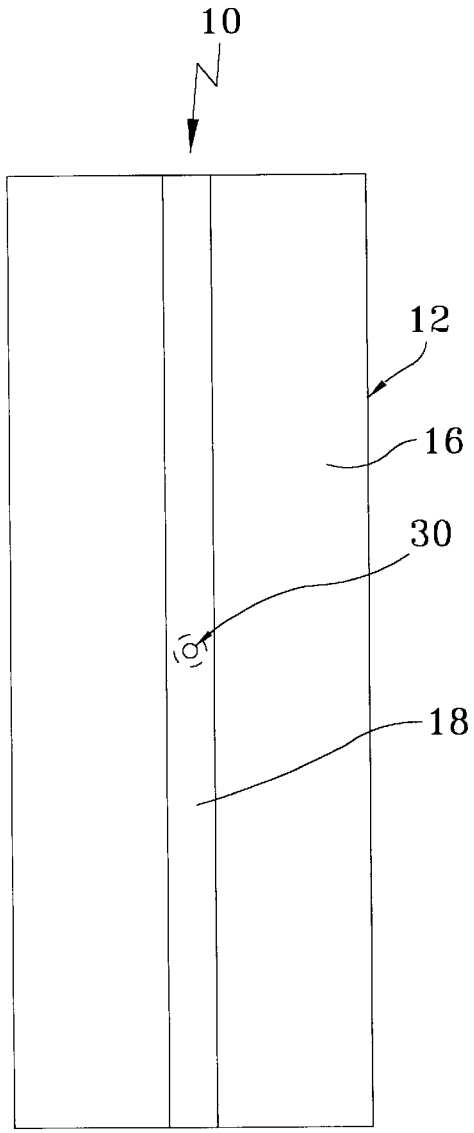
FIG. 2 shows a bottom view of the present invention.
Figure 3:
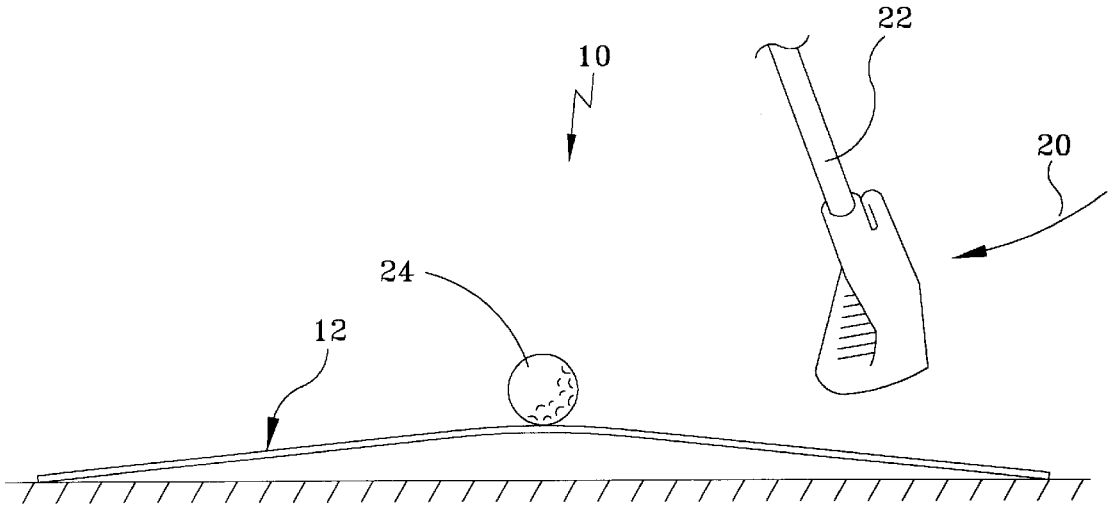
FIG. 3 is a side view of the present invention in use showing the base placed in a convex position.

With reference to FIGS. 1 through 4, where like elements have been given like numerical designations to facilitate understanding of the present invention, the ball support and golf swing aid for golf practice is designated generally 10. In the preferred embodiment, ball support 10 has a substantially flat base 12 having a smooth top surface 14 and a bottom surface 16. Base 12 should be made of a resiliently deformable, translucent material, such as polyethylene plastic, that is capable of being placed in a flexible convex shape (as shown in FIG. 3) and maintaining that shape during use.

The thickness of base 12 should be sufficient to provide support to base 12 when in the convex position, yet thin enough to allow a golfer to manually bend base 12 with his or her hands. Base 12 can be of virtually any size or shape desired. However, the present inventor has found that a rectangular base having dimensions of approximately six inches wide by fourteen inches long and one-eighth of an inch thick provides a good base for the invention. Although other sizes also work well, the size of base described above provides sufficient hitting surface and allows base 12 to be easily bent into an arch or low bell curve-like shape. Although base 12 can function with other shapes, such as circular or oval, a rectangular shape is better suited for obtaining the desired convex bend.

In the preferred embodiment, base 12 has target line 18 attached to bottom surface 16. Target line 18 can be one or more strips of colored plastic tape centrally disposed along and parallel with the longitudinal axis of base 12. In use, target line 18 should be orientated in the direction the golfer wants the ball to go, to provide a visual guide to the golfer. Swing path 20 denotes the path that golf club 22 should take in order to properly strike golf ball 24. Because base 12 is translucent, target line 18 on bottom surface 16 will be visible to the golfer looking down at top surface 14. Placing target line 18 on bottom surface 16 reduces the likelihood that golf club 22 will damage target line 18 during use. Target line 18 can be any color, as long as it is visible from a standing position. Alternatively, the direction to the target can be denoted by a target line 18 made integral with base 12 or placed on top surface 14, if the material selected is sufficiently durable to resist damage during use.

Figure 4:
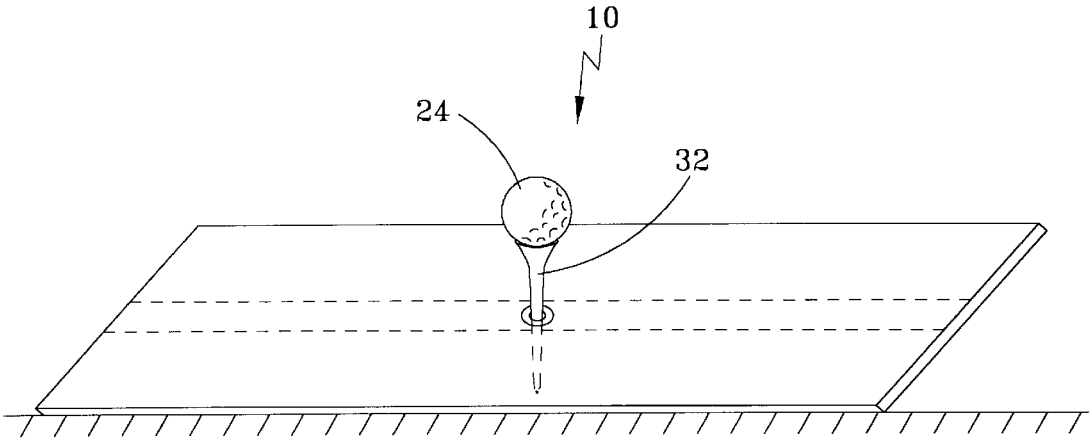
FIG. 4 is a perspective view of the present invention showing the use of a conventional golf tee placed through a hole in the recess.

In the preferred embodiment, top surface 14 of base 12 has a recess 26 positioned in target line 18 for receiving ball 24 and holding it in place during use of the present invention 10. Recess 26 should be sized to allow a conventional sized golf ball 24 to be supported such that ball 24 contacts top edge 28 of recess 26. Recess 26 can include a centrally located through hole 30 at the bottom of recess 26 for receiving conventional golf tee 32, as shown in FIG. 4.

In use, a golfer will select a place from which to practice his or her golf swing. Due to the nature of the present invention 10 the golfer is not limited to a turf area. Typically, the golfer will place base 12 in a convex shape, as shown in FIG. 3. Because base 12 is made from a relatively thin and flexible plastic material which can hold its shape, the golfer can merely use his or her hands to manually bend base 12 into the desired curvature. After obtaining the desired shape for base 12, the golfer places it on the ground such that target line 18 is aimed in the direction the golfer wants golf ball 24 to travel. The golfer then places golf ball 24 into recess 26 and places himself or herself into a standing position to swing at ball 24 with golf club 22.

The golfer will attempt to swing golf club 22 towards ball 24 along preferred swing path 20. When the golfer swings at ball 24, golf club 22 will slide along smooth top surface 14, displace base 12 downward and strike ball 24. Having base 12 in a convex shape provides the golfer with a cushioned, spring-like resistance which will prevent or reduce the amount of jarring shock experienced by the golfer, thereby reducing the likelihood of injuries or equipment damage from such jarring, and simulate the feel of a golf swing on a natural fairway.

Although the description above contains many specificities, these should not be construed as limiting the scope of the invention but as merely providing illustrations of some of the presently preferred embodiments of this invention. It will be readily apparent to those skilled in the art that the invention is not limited by the examples given, but is susceptible to various modifications in design and materials without departing from the spirit and scope of the invention. In particular, it should-be noted that the present invention is subject to modification with regard to the dimensional relationships set forth herein and modifications in assembly, materials, size, shape and use. Accordingly, it is appropriate that the appended claims be construed broadly and in a manner consistent with the spirit and scope of the invention described herein, rather than by the examples given.

I claim:

1. A ball support and golf swing aid for golf practice, comprising:

a substantially flat rectangular base having a smooth top surface and a bottom surface, said base being suitably dimensioned and made of a resiliently deformable material suitable for convexly disposing said base and providing the golfer with a cushioned, spring like resistance which will prevent or reduce the amount of jarring shock experienced by the golfer, thereby reducing the likelihood of injuries or equipment damage from such jarring, and simulate the feel of a golf swing on a natural fairway;

alignment means on said base for aligning said base with a preferred direction of travel for a golf ball that is to be hit. from said base by a golf club, said alignment means oriented substantially parallel to the longitudinal axis of said base; and a recess in said top surface, said recess sized so that a conventional golf ball supported on said recess contacts a top edge of said recess.

2. The ball support and golf swing aid according to claim 1, wherein said alignment means is centrally displaced along the longitudinal axis of said base.

3. The ball support and golf swing aid according to claim 1, wherein said base is translucent.

4. The ball support and golf swing aid according to claim 3, wherein said alignment means is on said bottom surface of said base.

5. The ball support and golf swing aid according to claim 1, wherein said recess is centrally disposed on said base.

6. The ball support and golf swing aid according to claim 1, wherein said recess further comprises a centrally located through hole.

7. The ball support and golf swing aid according to claim 1, wherein the length of said base is substantially longer than the diameter of said conventional golf ball.

8. A ball support and golf swing aid for golf practice, comprising:

a substantially flat rectangular base having a smooth top surface and a bottom surface, said base being suitably dimensioned and made of a resiliently deformable material suitable for convexly disposing said base and providing the golfer with a cushioned, spring like resistance which will prevent or reduce the amount of jarring shock experienced by the golfer, thereby reducing the likelihood of injuries or equipment damage from such jarring, and simulate the feel of a golf swing on a natural fairway;

alignment means on said base for aligning said base with a preferred direction of travel for a golf ball that is to be hit from said base by a golf club, said alignment means substantially parallel with the longitudinal axis of said base; and a recess in said top surface, said recess centrally disposed on said base, said recess sized so that a conventional golf ball supported on said recess contacts a top edge of said recess, said recess having a centrally located through hole, said through hole sized to pass the stem of a conventional golf tee.

9. The ball support and golf swing aid according to claim 8, wherein the length of said base is substantially longer than the diameter of said conventional golf ball.

* * * * *